US009856593B2

(12) United States Patent
Wishney et al.

(10) Patent No.: US 9,856,593 B2
(45) Date of Patent: Jan. 2, 2018

(54) WASHING MACHINE

(71) Applicant: SAMSUNG ELECTRONICS CO., LTD., Suwon-si (KR)

(72) Inventors: Adam Andrew Wishney, Singapore (SG); Seong-Min Oak, Hwaseong-si (KR); Se Gi Chon, Seongnam-si (KR)

(73) Assignee: SAMSUNG ELECTRONICS CO., LTD., Suwon-si (KR)

( * ) Notice: Subject to any disclaimer, the term of this patent is extended or adjusted under 35 U.S.C. 154(b) by 0 days.

(21) Appl. No.: 14/684,679

(22) Filed: Apr. 13, 2015

(65) Prior Publication Data

US 2015/0292135 A1 Oct. 15, 2015

(30) Foreign Application Priority Data

Apr. 11, 2014 (KR) ..... 10-2014-0043442

(51) Int. Cl.
*D06F 37/10* (2006.01)
*D06F 39/14* (2006.01)

(52) U.S. Cl.
CPC ..... *D06F 37/10* (2013.01); *D06F 39/14* (2013.01)

(58) Field of Classification Search
CPC ..... D06F 37/10; D06F 39/02; D06F 39/022; D06F 39/08; D06F 39/083; D06F 39/088; D06F 39/14
See application file for complete search history.

(56) References Cited

U.S. PATENT DOCUMENTS 1,549,965 A * 8/1925 Everett ..... D06F 37/10 68/139
3,696,521 A 10/1972 Hubbard
5,548,978 A * 8/1996 Bongini ..... D06F 37/28 68/17 R
2004/0020246 A1* 2/2004 Yun ..... D06F 39/14 68/24
2004/0163426 A1* 8/2004 Kim ..... D06F 39/14 68/23 A (Continued)

FOREIGN PATENT DOCUMENTS

CN 1746413 3/2006
DE 2244751 3/1974
EP 1 262 589 A2 12/2002

(Continued)

OTHER PUBLICATIONS

Extended European Search Report dated Jun. 25, 2015 in corresponding European Patent Application No. 15163125.6.

(Continued)

*Primary Examiner* — David Cormier
(74) *Attorney, Agent, or Firm* — Staas & Halsey LLP

(57) ABSTRACT

Disclosed is a washing machine having an improved structure of enabling laundry to be put into the washing machine without restraint, the washing machine including a cabinet forming an external appearance of the washing machine, and provided at a front side thereof with an inlet port, a tub provided in the cabinet and accommodating wash water, a drum rotatably provided in the tub, and a door installed at the cabinet to open and close the inlet port, wherein the door is provided with a subsidiary door that is freely open and closed independent of the door during a washing cycle.

10 Claims, 7 Drawing Sheets

(56) References Cited

U.S. PATENT DOCUMENTS

2005/0034486 A1* 2/2005 Bienick ..... F24C 15/04
68/3 R

FOREIGN PATENT DOCUMENTS

| | | | |
|---|---|---|---|
| EP | 1389643 | | 2/2004 |
| EP | 2 415 920 | A1 | 2/2012 |
| KR | 10-2004-0015480 | | 2/2004 |
| KR | 10-2006-0023016 | | 3/2006 |
| KR | 10-0751779 | | 8/2007 |
| KR | 10-2008-0054628 | | 6/2008 |
| KR | 10-2009-0096948 | | 9/2009 |
| KR | 10-2012-0022364 | | 3/2012 |

OTHER PUBLICATIONS

Chinese Office Action dated Jul. 29, 2016 in Chinese Patent Application No. 201510172929.7.
Chinese Office Action dated Mar. 9, 2017 in Chinese Patent Application No. 201510172929.7.
European Decision on Grant dated Apr. 18, 2017 in European Patent Application No. 15163125.6.
Chinese Office Action dated Sep. 4, 2017 in Chinese Patent Application No. 201510172929.7.
Extended European Search Report dated Sep. 5, 2017 in European Patent Application No. 17173785.1.

* cited by examiner

WASHING MACHINE

CROSS-REFERENCE TO RELATED APPLICATION

This application claims the priority benefit of Korean Patent Application No. 10-2014-0043442, filed on Apr. 11, 2014, in the Korean Intellectual Property Office, the disclosure of which is incorporated herein by reference.

BACKGROUND

1. Field

Embodiments of the present disclosure relate to a washing machine, and more particularly, to a washing machine having an improved structure of enabling laundry to be put into the washing machine without restraint.

2. Description of the Related Art

Generally, a washing machine is designed to wash clothes using power, and classified into a drum washing machine, in which a drum is disposed in a parallel direction so that laundry is lifted along an inner circumferential surface of the drum and is dropped when the drum rotates forward and backward with respect to a parallel shaft, and therefore, the laundry is washed, and a vertical washing machine, in which a drum provided at an inside thereof with a pulsator is disposed in a vertical direction so that a water current is generated by the pulsator when the drum rotates forward and backward with respect to a vertical shaft, and therefore the laundry is washed by using the water current.

The drum washing machine includes a cabinet forming the external appearance thereof, a cylindrical tub installed in the cabinet and containing wash water, a drum rotatably installed in the tub to wash laundry, a driving motor disposed at a rear of the tub to rotate the drum, and a door installed at a front surface of the cabinet. The cabinet is provided on at least one portion thereof with an inlet port that communicates with the drum, and the door is configured to open and close the inlet port.

When the drum washing machine starts a washing cycle, the door enters a locking state. Accordingly, if a user desires to additionally put laundry or detergent into the drum, the user needs to wait until the washing cycle is finished, or needs to stop the washing cycle and then wait until the draining of wash water is finished.

In addition, there may be a type of laundry that may be damaged during the washing cycle.

SUMMARY

Therefore, it is an aspect of the present disclosure to provide a washing machine having an improved structure of enabling laundry and detergent to be put into the washing machine during a washing cycle without restraint.

It is another aspect of the present disclosure to provide a washing machine having an improved structure in which an additional washing space is formed.

Additional aspects of the invention will be set forth in part in the description which follows and, in part, will be obvious from the description, or may be learned by practice of the invention.

In accordance with one aspect of the present disclosure, a washing machine includes a cabinet, a tub, a drum and a door. The cabinet may form an external appearance of the washing machine, and may be provided at a front side thereof with an inlet port. The tub may be provided in the cabinet and accommodate wash water. The drum may be rotatably provided in the tub. The door may be installed at the cabinet to open and close the inlet port. The door may be provided with a subsidiary door that is freely open and closed independent of the door during a washing cycle.

The subsidiary door may be provided at the door so as to protrude forward.

The subsidiary door may be open and closed upward and downward.

The door may be provided at an inside thereof with a subsidiary inlet port that may be open and closed by the subsidiary door and with a connection part connecting the subsidiary inlet port to the drum.

The connection part may be inclined downward while extending to the inside of the door.

The door may include a front housing at which the subsidiary door may be provided and a rear housing that may be coupled to the front housing to form the connection part in the door and may be provided at a rear side thereof with an opening part communicating with the drum.

The rear housing may protrude backward of the door, and a degree of the rear housing being protruded may be decreased upward.

At least one of the subsidiary door and the subsidiary inlet port may have a diaphragm installed thereon to prevent water leakage.

The subsidiary door may remain in a locking state during a washing process, and when the locking state of the subsidiary is released, the drum may stop rotating.

In accordance with another aspect of the present invention, a washing machine includes a cabinet, a tub, a drum and a door. The cabinet may form an external appearance of the washing machine, and may be provided at a front side thereof with an inlet port. The tub may be provided in the cabinet and may accommodate wash water. The drum may be rotatably provided in the tub, and may have a main washing space in which laundry may be washed. The door may be installed on the cabinet to open and close the inlet port. The door may be provided at an inside thereof with a subsidiary washing space in which a washing operation may be performed independent of performing a washing operation in the main washing space.

The door may be provided at a front side thereof with a subsidiary door to open and close the subsidiary washing space.

The door may include a front housing at which the subsidiary door may be provided and a rear housing that may be coupled to the front housing to form the subsidiary washing space in the door and may be provided at a rear side thereof with an opening part communicating with the drum.

The subsidiary door may be provided at an upper portion of the front housing to be open and closed upward and downward. The subsidiary washing space may be inclined downward while extending to the inside of the door.

The door may further include a cover detachably coupled to the opening part. The cover may be coupled to the opening part to form the subsidiary washing space that is divided from the main washing space.

The cover may have a pulsator installed thereon to form a flow of wash water stored in the subsidiary washing space.

At least one of the opening part and the cover may have a diaphragm installed thereon to prevent water leakage.

BRIEF DESCRIPTION OF THE DRAWINGS

These and/or other aspects of the disclosure will become apparent and more readily appreciated from the following description of the embodiments, taken in conjunction with the accompanying drawings of which.

DETAILED DESCRIPTION

Figure 1:
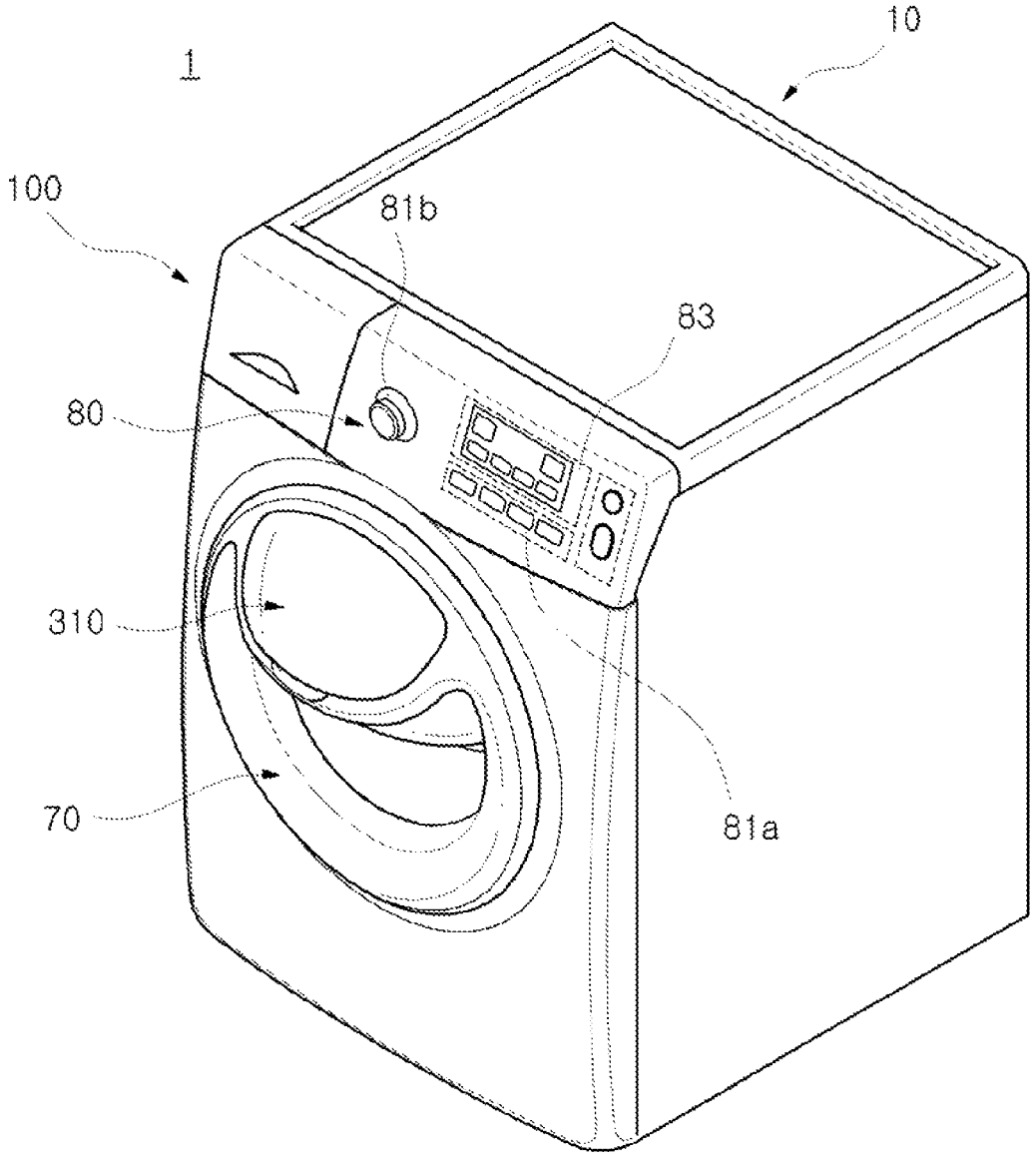
FIG. 1 is a perspective view illustrating the external appearance of a washing machine in accordance with an embodiment of the present disclosure.

Reference will now be made in detail to the embodiments of the present disclosure, examples of which are illustrated in the accompanying drawings, wherein like reference numerals refer to like elements throughout. Meanwhile, spatially relative terms, such as "a front end," "a rear end," "an upper part," "a lower part," "an upper end" and "a lower end" and the like, may be used herein for ease of description to describe one element's or feature's relationship to another element(s) or feature(s) as illustrated in the figures. It will be understood that the spatially relative terms are intended to encompass different orientations of the device in use or operation in addition to the orientation depicted in the figures.

Figure 2:
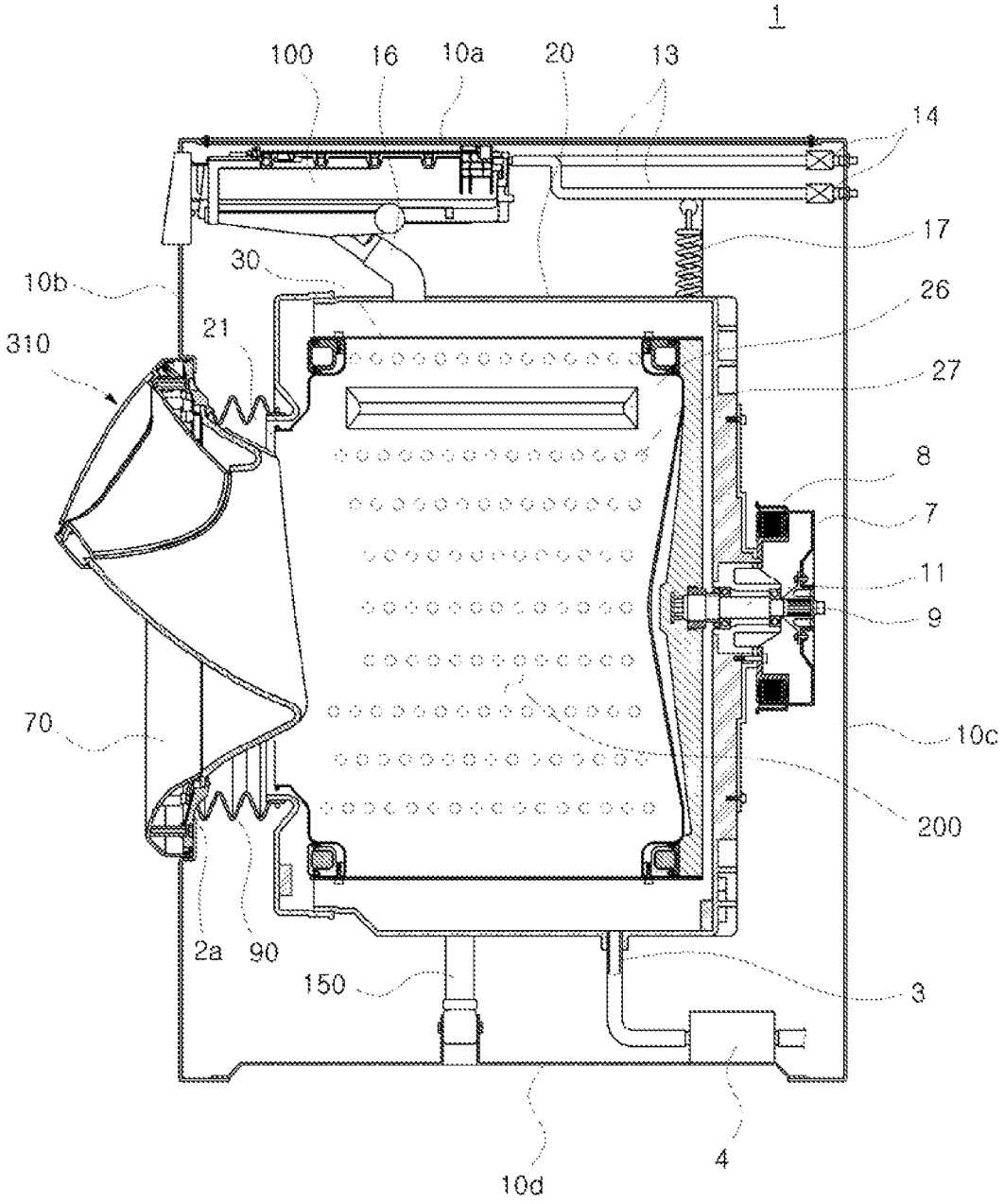
FIG. 2 is a cross-sectional view of a washing machine in accordance with an embodiment of the present disclosure.
Figure 3:
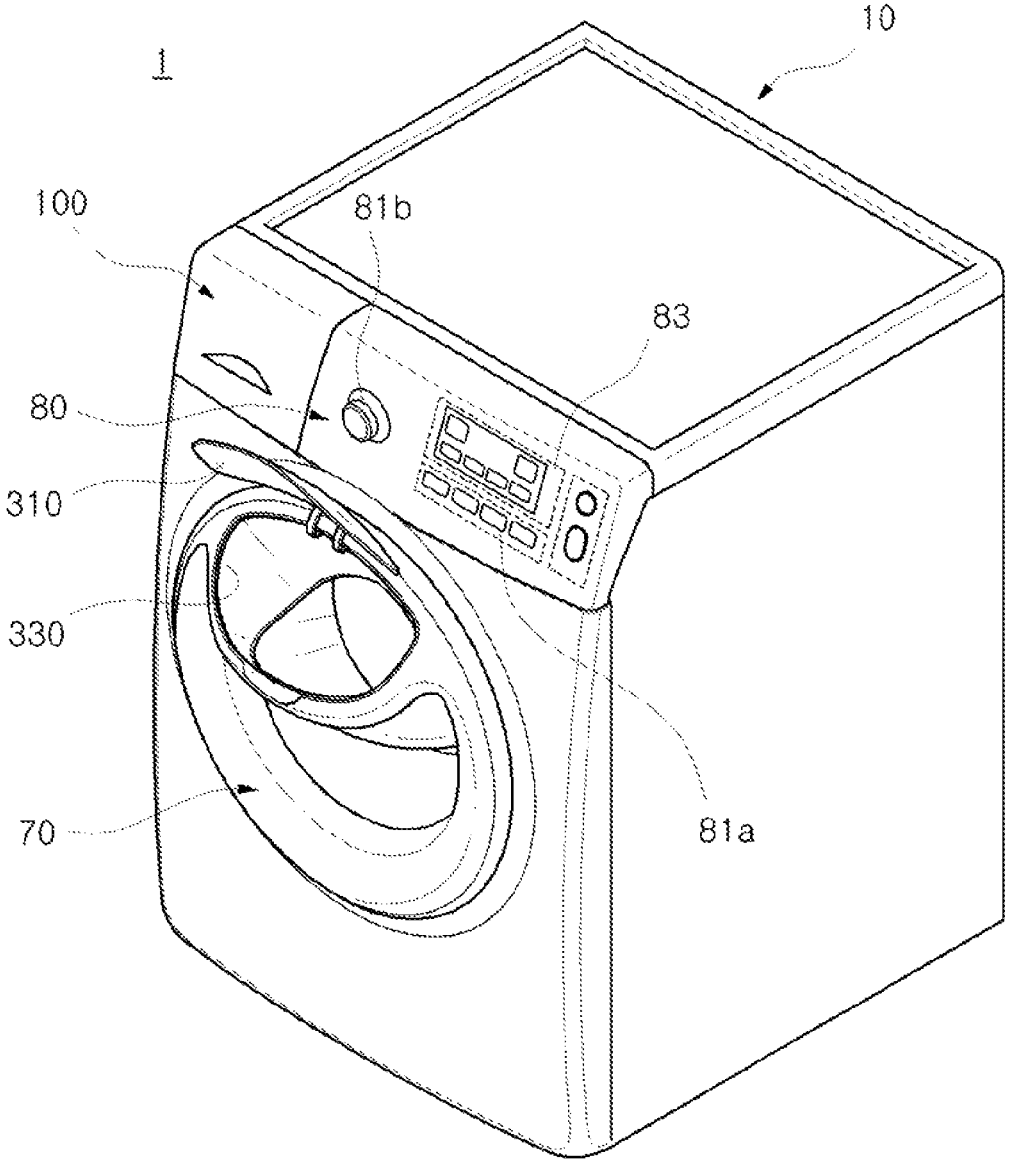
FIG. 3 is a perspective view illustrating a state in which a subsidiary door of a washing machine is open in accordance with an embodiment of the present disclosure.
Figure 4:
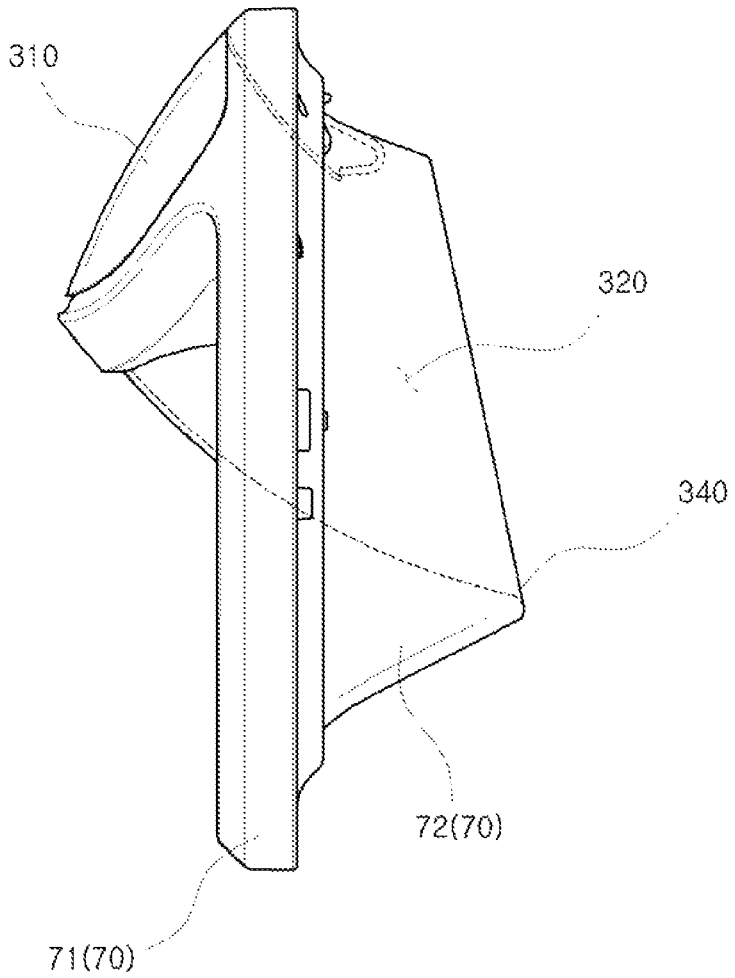
FIG. 4 is a side view illustrating a door of a washing machine in accordance with an embodiment of the present disclosure.

FIG. 1 is a perspective view illustrating the external appearance of a washing machine in accordance with an embodiment of the present disclosure, FIG. 2 is a cross-sectional view of a washing machine in accordance with an embodiment of the present disclosure, FIG. 3 is a perspective view illustrating a state in which a subsidiary door of a washing machine is open in accordance with an embodiment of the present disclosure, and FIG. 4 is a side view illustrating a door of a washing machine in accordance with an embodiment of the present disclosure.

Referring to FIGS. 1 to 4, a washing machine 1 according to an embodiment of the present disclosure includes a cabinet 10 forming the external appearance of the washing machine 1, a tub 20 accommodating washing water or rinse water that are used for a washing cycle or a rinsing cycle, a drum 30 accommodating laundry, and a driving motor 7 rotating the drum 30.

The cabinet 10 is provided with a control panel 80 including input parts 81*a* and 81*b* to receive an operation command of the washing machine 1 and a display part 83 to display operation information of the washing machine 1.

The input parts 81*a* and 81*b* may receive user's commands related to operations of the washing machine 1, for example, a time of a washing process, a frequency of rinsing operations, a time of a spin dry operation, a time of a dry operation, and a start/pause, and the input parts 81*a* and 81*b* may be implemented using a press-in type button 81*a* or a rotary type button 81*b*. In addition, the display part 83 may display information about operations of the washing machine 1, for example, the amount of wash water, a cycle being in operation by the washing machine 1 and a time remaining until a washing is finished, and the display part 83 may be implemented using a liquid crystal display (LCD) panel and a light emitting diode (LED) panel.

Although the washing machine 1 according to the embodiment of the present disclosure includes the input parts 81*a* and 81*b* separately from the display part 83, the present disclosure is not limited thereto. For example, an input part and a display part may be integrally formed with each other by using a touch screen panel (TSP).

In addition, the cabinet 10 includes frames 10*a*, 10*b*, 10*c* and 10*d*, made up of an upper surface frame 10*a* forming an upper surface of the cabinet 10, a front surface frame 10*b* forming a front surface of the cabinet 10, a rear surface frame 10*c* forming a rear surface of the cabinet 10, and a side frame (not shown) forming a side surface and a lower surface of the cabinet 10 while connecting the front surface frame 10*b* to the rear surface frame 10*c*.

The cabinet 10 is provided with an inlet port 2*a* through which laundry is put into the drum 30. The inlet port 2*a* is open and closed by a door 70 installed on the front surface frame 10*b*.

A diaphragm 90 is configured to connect the cabinet 10 to the tub 20. The diaphragm 90 is disposed between the inlet port 2*a* of the front surface frame 10*a* and an opening 21 inside the tub 20, to form a path leading from the inlet port 2*a* of the front surface frame 10*a* to the opening 21, and to reduce vibration transmitted to the front surface frame 10*a* during rotation of the drum 30. In addition, a portion of the diaphragm 90 is disposed between the door 70 and the front surface frame 10*a* to prevent wash water from leaking to the outside of the cabinet 10.

The diaphragm 90 may include an injection molded product formed of thermoplastic elastomer. Since the thermoplastic elastomer has elasticity at the room temperature, as with rubber, the diaphragm formed of thermo elastomer may be effectively attenuate vibration being transmitted from the tub 20 to the front surface frame 10*a* of the cabinet 10.

A spring 17 may be provided between the tub 20 and the cabinet 10 to support the tub 20 upward. The spring 17 serves to mitigate vibration and noise, which may be generated due to movement of the tub 20, by using the elastic force thereof.

A water supply pipe 13 is installed above the tub 20 to supply wash water to the tub 20. A water supply valve 14 is installed at one side of the water supply pipe 13.

A detergent supply apparatus 100 is connected to the tub 20 via a connection pipe 16, and water supplied via the water supply pipe 13 is supplied into the tub 20 together with detergent via the detergent supply apparatus 100.

The tub 20 is supported by a damper 150, and the damper 150 connects an inner bottom of the cabinet 10 to an outer surface of the tub 20. In addition, the damper 150 may be positioned at an upper side and left/right sides other than the inner bottom of the cabinet 10 to support the tub 20. At an upper side and a lower side of the tub 20, the damper 150 or the spring 17 may mitigate vibration or impact that may be generated due to vertical movements of the tub 20.

The tub 20 may be supported by at least one damper 150.

A driving shaft 11 is connected to a rear surface of the drum 30 to transmit power from the driving motor 7. A plurality of through-holes 27 are formed through a peripheral surface of the drum 30 to circulate wash water. A plurality of lifters 26 are installed on an inner circumferential surface of the drum 30 such that laundry is lifted and dropped during rotation of the drum 30.

The driving shaft 11 is disposed between the drum 30 and the driving motor 7. One end of the driving shaft 11 is connected to a rear plate of the drum 30, and the other end of the driving shaft 11 extends outside a rear wall of the tub 20. If the driving motor 7 drives the driving shaft 11, the drum 30 connected to the driving shaft 11 rotates about the driving shaft 11.

A bearing housing 8 is installed to the rear wall of the tub 20 so as to rotatably support the driving shaft 11. The bearing housing 8 may be made of aluminum alloy, and may be inserted into the rear wall of the tub 20 when the tub 20 is formed by injection molding. Bearings 9 are disposed between the bearing housing 8 and the driving shaft 11 so that the driving shaft 11 may effectively rotate.

A drainage pump 4 that discharges water in the tub 10 toward an outer side of the cabinet 10, a connection hose 3 that connects the tub 20 and the drainage pump 4 so that water in the tub 20 may flow into the drainage pump 70, and a drainage hose (not shown) that guides water pumped by the drainage pump 4 to the outer side of the cabinet 10 are disposed below the tub 20.

The washing machine 1 may further include a subsidiary door 310 configured to be freely open and closed during a washing process independent of the door 70.

The subsidiary door 310 may be provided at the door 70 and protrude forward.

The subsidiary door 310 may be provided at the door 70 while adjacent to the upper surface frame 10*a*. In detail, the subsidiary door 310 may be installed at a position higher than a top surface of wash water in order to prevent wash water in a main washing space 200 and a subsidiary washing space 300 from being overflown when the subsidiary door 310 is open and closed during a washing cycle.

The subsidiary door 310 may be rotatably installed at the door 70.

One side of the subsidiary door 310 may be hinged to the door 70.

When a left side or a right side of the subsidiary door 310 is hinged to the door 70, the subsidiary door 310 may be open and closed leftward and rightward. When an upper side or a lower side of the subsidiary door 310 is hinged to the door 70, the subsidiary door 310 may be open and closed upward and downward. Preferably, an upper side of the subsidiary door 310 may be hinged to the door 70 such that the subsidiary door 310 is open and closed upward and downward.

A locking part (not shown) may be formed at the other side of the subsidiary door 310.

The locking part of the subsidiary door 310 may be detachably inserted into a fixing hole (not shown) formed through the door 70. That is, when the locking part of the subsidiary door 310 is inserted into the fixing hole of the door 70, the subsidiary door 310 remains in a closed state, and when the locking part of the subsidiary door 310 is separated from the fixing hole of the door 70, the subsidiary door 310 remains in an open state.

One side of the subsidiary door 310 hinged to the door 70 may be a side opposite to the other side of the subsidiary door 310 at which the locking part is formed. That is, when the left side of the subsidiary door 310 is hinged to the door 70, the locking part may be formed at the right side of the subsidiary door 310. When the right side of the subsidiary door 310 is hinged to the door 70, the locking part may be formed at the left side of the subsidiary door 310. When the upper side of the subsidiary door 310 is hinged to the door 70, the locking part may be formed at the lower side of the subsidiary door 310. When the lower side of the subsidiary door 310 is hinged to the door 70, the locking part may be formed at the upper side of the subsidiary door 310

The subsidiary door 310 remains in a locking state during a washing process, and when the locking state of the subsidiary door 310 is released, the drum 30 stops rotating.

Whether or not the subsidiary door 310 is in a locking state, that is, whether or not the subsidiary door 310 is able to be open and closed may be determined by a sensor (not shown). For example, it is determined whether the subsidiary door 310 is able to be open and closed, by use of an optical sensor (not shown). The optical sensor may include a light emitting part (not shown) that emits light in a direction depending on the movement of the subsidiary door 310 and a light receiving part (not shown) that receives light radiated from the light emitting part and outputs a signal having a magnitude corresponding to the amount of light received. A control part (not shown) determines whether the subsidiary door 310 is able to be open and closed, by analyzing the signal output from the light receiving part, and according to a result of the determination, controls the operation of the drum 30.

The method of determining whether or not the subsidiary door 310 is able to open and closed is not limited thereto, and may be variously implemented.

The door 70 is provided at an inside thereof with a subsidiary inlet port 330 and a connection part 320.

The subsidiary inlet port 330 is open and closed by the subsidiary door 310. The connection part 320 connects the subsidiary inlet port 330 to the drum 30.

The door 70 includes a front housing 71 and a rear housing 72.

The front housing 71 is provided with the subsidiary door 310.

The rear housing 72 is coupled to the front housing 71 to form the connection part 320 in the door 70 and is provided at a rear side thereof with an opening part 340 communicating with the drum 30.

The opening part 340 may be formed at one end portion of the connection part 320, which faces the rear side, and the subsidiary inlet port 330 may be formed at the other end portion of the connection part 320, which faces the front side.

The connection part 320 may be inclined downward as it extends to the inside of the door 70. That is, the connection part 320 may be inclined downward as it extends further toward the opening part 340. Accordingly, the subsidiary inlet port 330 may be formed at a position higher than a position of the opening part 340. Through such a configuration, laundry or detergent put through the subsidiary inlet port 330 may be slid in the gravity direction along the connection part 320, and thus effectively transferred to the drum 30.

The rear housing 72 may protrude toward the rear side of the door 70.

The degree of the rear housing 72 being protruded to the rear side of the door 70 may be decreased upward. Accordingly, laundry put through the subsidiary inlet port 330 is prevented from being damaged as being caught at the diaphragm 90 connecting the cabinet 10 to the tub 20.

A diaphragm (not shown) may be installed on at least one of the subsidiary door 310 and the subsidiary inlet port 330 to prevent from water leakage.

The diaphragm may include an injection molded product formed of thermoplastic elastomer. Since the thermoplastic elastomer has elasticity at the room temperature, as with rubber, the diaphragm formed of thermo elastomer may be effectively prevent water leakage.

At least one of the door 70 and the subsidiary door 310 may include transparent material allowing a user to observe the washing process with naked eyes. According to an embodiment of the present disclosure, the door 70 and the subsidiary door 310 may include reinforced glass.

Figure 5:
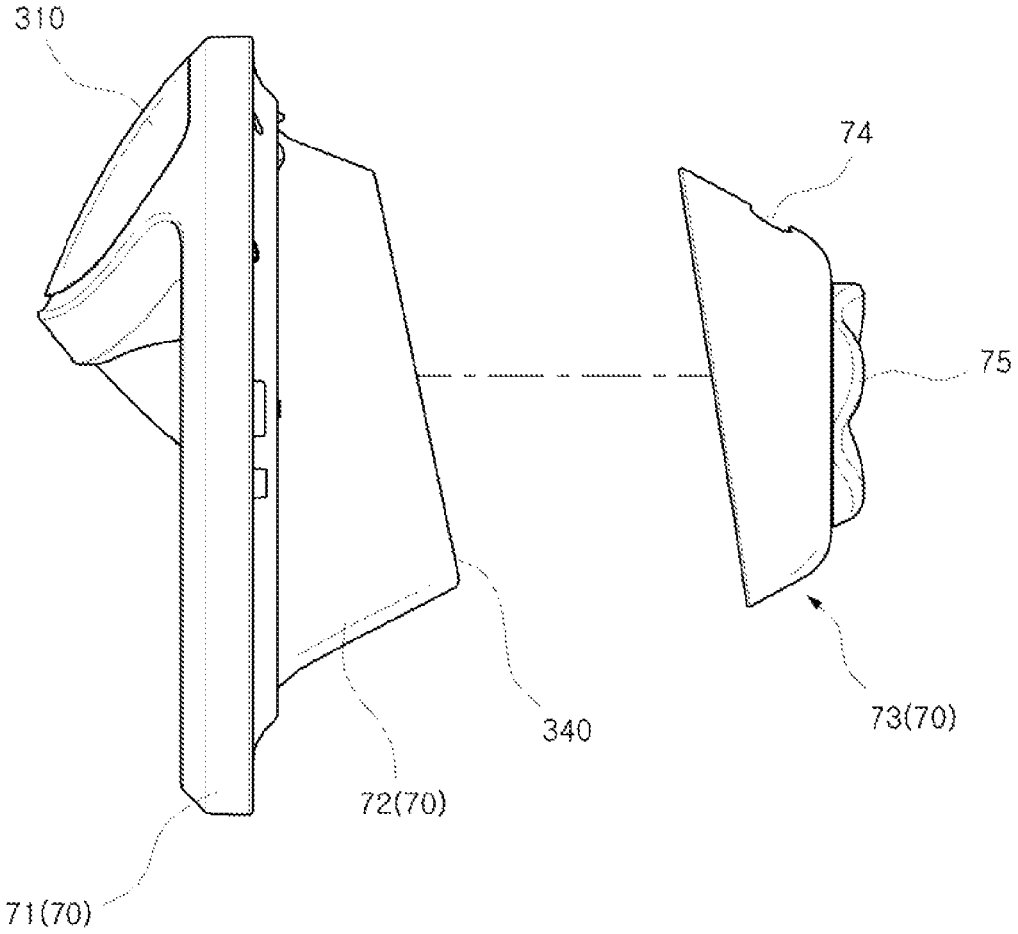
FIG. 5 is a view illustrating a state in which a door of a washing machine is coupled to a cover mounted at a rear of the door in accordance with an embodiment of the present disclosure.
Figure 6:
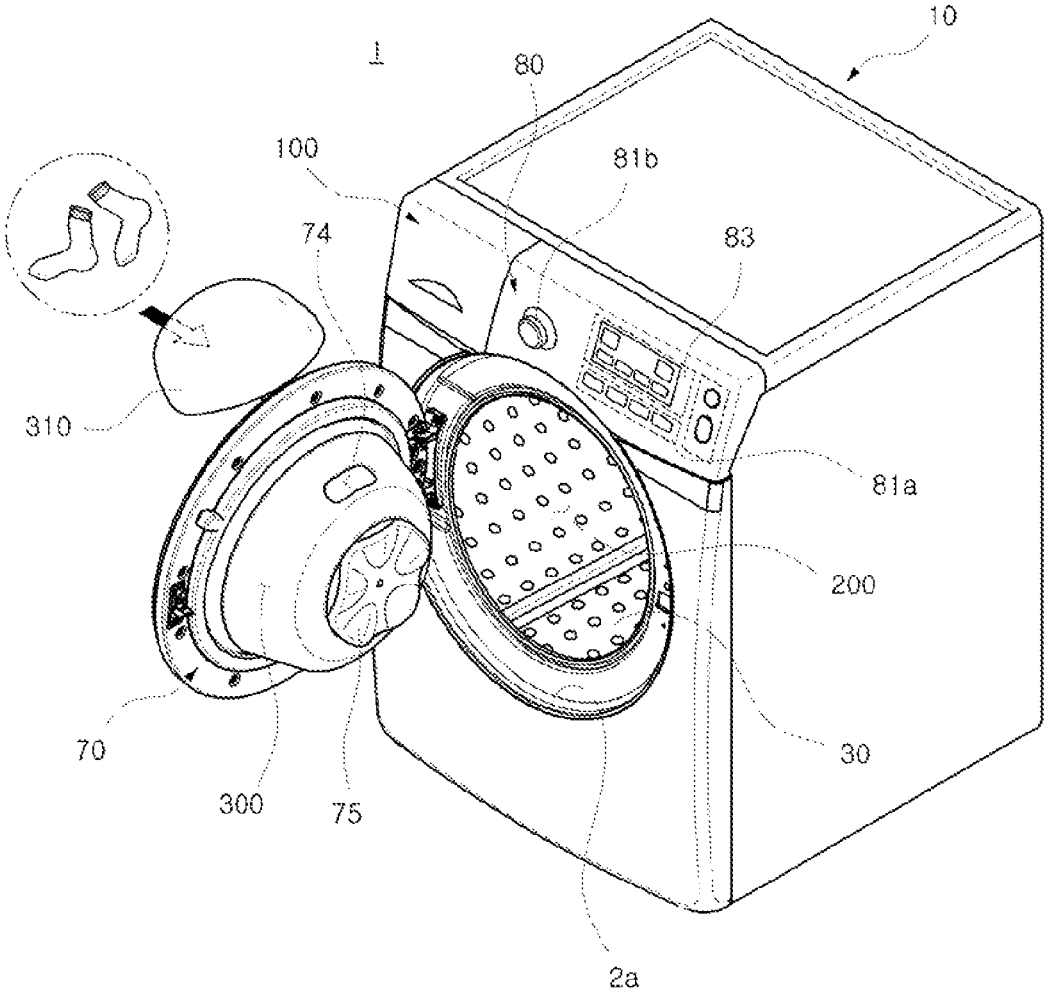
FIG. 6 is a view illustrating a state in which laundry is put into a subsidiary washing space of a washing machine in accordance with an embodiment of the present disclosure.

FIG. 5 is a view illustrating a state in which a door of a washing machine is coupled to a cover mounted at a rear of the door in accordance with an embodiment of the present disclosure, and FIG. 6 is a view illustrating a state in which laundry is put into a subsidiary washing space of a washing machine in accordance with an embodiment of the present disclosure. In the following description, elements identical to those described above are designated by the same reference numerals shown in FIGS. 1 to 4, and detailed description thereof will be omitted description. The subsidiary washing space 300 may include the connection part 320 described in FIGS. 1 to 4.

Referring to FIGS. 5 and 6, the washing machine 1 may include the main washing space 200 and the subsidiary washing space 300

A washing process in the main washing space 200 may be performed independent of a washing process in the subsidiary washing space 300. That is, the subsidiary washing space 300 may be divided from the main washing space 200.

The main washing space 200 may be formed in the drum 30.

The subsidiary washing space 300 may be formed in the door 70.

The door 70 may include the front housing 71 and the rear housing 72.

The front housing 71 may be provided with the subsidiary door 310 to open and close the subsidiary washing space 300.

The rear housing 72 is coupled to the front housing 71 to form the subsidiary washing space 300 and is provided at a rear side thereof with the opening part 340 communicating with the drum 30.

The door 70 may further include a cover 73.

In detail, the cover 73 is detachably coupled to the opening part 340.

The front housing 71, the rear housing 72 and the cover 73 are coupled to each other to form the subsidiary washing space 300 that is divided from the main washing space 200.

The cover 73 may include transparent material.

A pulsator 75 may be installed at the cover 73 to form a flow of wash water stored in the subsidiary washing space 300. The pulsator 75 may be rotatable by a flow of wash water generated in the main washing space 200. Accordingly, the pulsator 75 may be rotated in the same direction as that of the drum 30.

A diaphragm (not shown) may be installed on at least of the opening part 340 and the cover 73 to prevent water leakage.

The cover 73 may be provided with a wash water inlet hole 74.

The subsidiary washing space 300 may have wash water to be sprayed therein independent of spraying was water into the main washing space 200. In detail, wash water may be sprayed into the subsidiary washing space 300 through the wash water inlet hole 74.

Wash water stored in the subsidiary washing space 300 may be drained independent of draining wash water stored in the main washing space 200.

Figure 7:
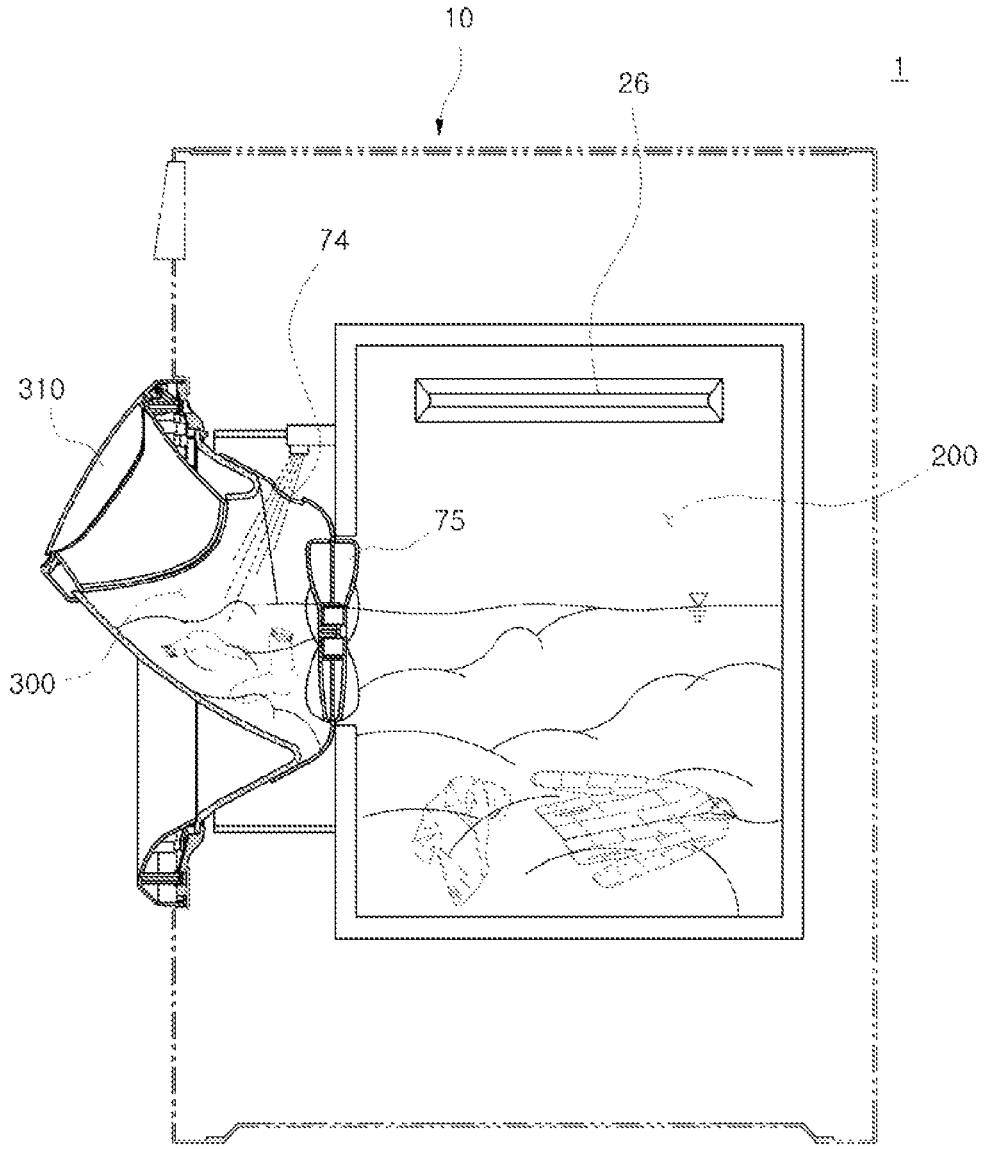
FIG. 7 is a schematic view illustrating a washing cycle of a washing machine in accordance with an embodiment of the present disclosure.

FIG. 7 is a schematic view illustrating a washing cycle of a washing machine in accordance with an embodiment of the present disclosure. In the following description, elements identical to those described above are designated by the same reference numerals shown in FIGS. 1 to 6.

Referring to FIG. 7, an operation of the washing machine 1 will be described.

When laundry or detergent is put into the main washing space 200 and the subsidiary washing space 300, an appropriate amount of wash water is supplied to the main washing space 200 and the subsidiary washing space 300. As described above, wash water may be supplied to the subsidiary washing space 300 through the wash water inlet hole 74 independent of supplying wash water to the main washing space 200.

As for the main washing space 200, the drum 30 is rotated according to an operation of the driving motor 7, and the lifter 26 lifts the laundry to a predetermined height and then drops the laundry, so that the laundry is washed.

As for the subsidiary washing space 300, the laundry is washed by use of a water current that is generated by the pulsator 75. The washing in the subsidiary washing space 300 may be performed in a gentle manner when compared to the washing in the main washing space 200, and thus suitable for washing laundry that is easily damaged.

After the washing cycle is finished as described above, the wash water each in the main washing space 200 and the subsidiary washing space 300 is drained, and a spin dry operation is intermittently performed. Thereafter, the water supply valve 14 is open, so that wash water is supplied to each of the main washing space 200 and the subsidiary washing space 300 at the same time when a rinsing cycle is performed.

As such, the rinsing cycle and the intermittent spin dry are repeatedly performed, and then a spin dry cycle is performed.

A user can freely put laundry and detergent into the washing machine by opening and closing a subsidiary door at a random point of time during a washing cycle.

A subsidiary washing space divided from a main washing space is installed so that a separate washing is performed depending on the type of laundry, and thus the degree of damage to the laundry can be reduced.

Although a few embodiments of the present disclosure have been shown and described, it would be appreciated by those skilled in the art that changes may be made in these embodiments without departing from the principles and spirit of the disclosure, the scope of which is defined in the claims and their equivalents.

What is claimed is:

1. A washing machine comprising:

a cabinet forming an external appearance of the washing machine, and provided at a front side thereof with an inlet port;

a tub provided in the cabinet and accommodating wash water;

a drum rotatably provided in the tub;

a door installed at the cabinet to open and close the inlet port;

a subsidiary inlet port provided at a front side of the door; and a connection part extended from the subsidiary inlet port to an inside of the drum and inclined downward toward the drum along a lower portion of the connection part such that laundry can be loaded in the drum passing through the door.

2. The washing machine of claim 1, further comprising a subsidiary door configured to open and close the subsidiary inlet port.

3. The washing machine of claim 2, wherein the subsidiary door is coupled to the door to be opened upwardly.

4. The washing machine of claim 1, wherein at least a portion of the connection part is configured to be submerged in the wash water in the tub.

5. The washing machine of claim 1, wherein the connection part comprises an outlet port provided at an opposite side of the subsidiary inlet port, the outlet port being disposed lower than the subsidiary inlet port.

6. The washing machine of claim 5, wherein a lower portion of the outlet port is disposed closer to a rear side of the drum than an upper portion of the outlet port.

7. A washing machine comprising:

a cabinet forming an external appearance of the washing machine, and provided at a front side thereof with an inlet port;

a tub provided in the cabinet and accommodating wash water;

a drum rotatably provided in the tub, and having a main washing space in which laundry is washed;

a door installed on the cabinet to open and close the inlet port;

a subsidiary inlet port provided at a front side of the door;

a connection part extended from the subsidiary inlet port and inclined downward toward the drum along a lower portion of the connection part; and a rotatable pulsator provided at one side of the connection part opposing to the subsidiary inlet port.

8. The washing machine of claim 7, further comprising a subsidiary door to open and close the subsidiary inlet port.

9. The washing machine of claim 7, wherein the pulsator is disposed lower than the subsidiary inlet port.

10. The washing machine of claim 7, further comprising a water supply port disposed at an upper portion of the connection part.

* * * * *